US006179352B1

(12) United States Patent
Schneeberger

(10) Patent No.: US 6,179,352 B1
(45) Date of Patent: Jan. 30, 2001

(54) HANDLE LOCK

(76) Inventor: Eric W. Schneeberger, 14 Essex Grove, West Ridge, Durban, 4091, Kwa Zulu Natal (ZA)

( * ) Notice: Under 35 U.S.C. 154(b), the term of this patent shall be extended for 0 days.

(21) Appl. No.: 09/315,964

(22) Filed: May 21, 1999

(51) Int. Cl.[7] ..... E05B 1/00

(52) U.S. Cl. ..... 292/347; 292/336.3; 292/DIG. 63; 292/DIG. 37

(58) Field of Search ..... 292/348, 349, 292/352, 353, 355, 357–359, DIG. 2, DIG. 8, DIG. 65, 347, 336.3, 169.18, 165, 173, DIG. 63, DIG. 37

(56) References Cited

U.S. PATENT DOCUMENTS 2,117,947 * 5/1938 Rome et al. ..... 292/352
2,478,304 * 8/1949 Mulsow ..... 292/349
3,937,504 * 2/1976 McElroy ..... 292/337
5,029,916 * 7/1991 Chiu ..... 292/347
5,516,163 * 5/1996 Baker ..... 292/170
5,564,759 * 10/1996 McNutt ..... 292/336.3
5,577,780 * 11/1996 Justice ..... 292/170
5,947,535 * 9/1999 Baker ..... 292/165

* cited by examiner

*Primary Examiner*—Lynne H. Browne
*Assistant Examiner*—John B. Walsh
(74) *Attorney, Agent, or Firm*—Young & Thompson

(57) ABSTRACT

A handle lock includes a handle portion and a plate portion, the latter being attached to a door at the lock of the door, the handle being slidable in the plate between a first and second position and is also connected to a lock releasing element; releasable rotation preventing structure between the handle and the plate when the handle is in its first position comprising a formation in one of the handle or plate which coacts with a corresponding formation in the other in the first position and which is displaced from the corresponding formation by the movement from the first to the second position.

4 Claims, 3 Drawing Sheets

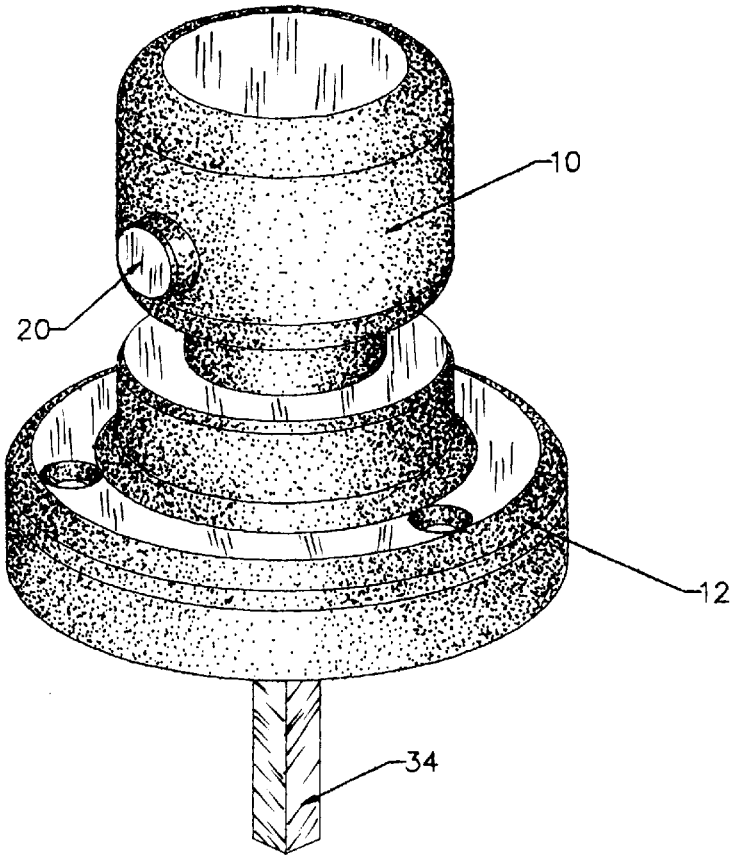
FIGURE 3
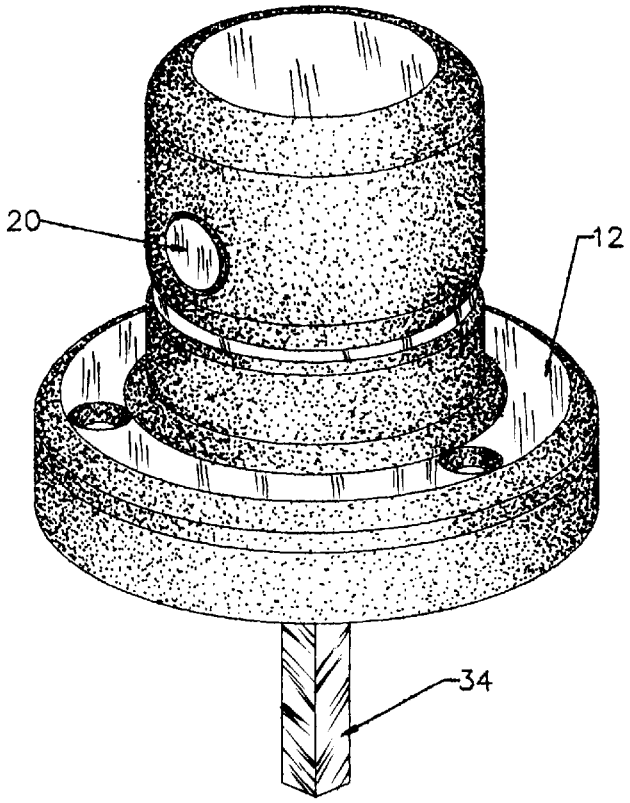

HANDLE LOCK

FIELD OF THE INVENTION

This invention relates to a handle lock which is primarily designed as a child-proof handle lock.

BACKGROUND OF THE INVENTION

Child fatalities resulting from ingestion of poisons or overdoses of other substances are common enough to take adequate precautions to prevent children from access to contents of cupboards.

As far as the Applicant is aware this has been achieved in the past by do it yourself arrangements or by elaborate arrangements which usually involve two separate or simultaneous actions which are beyond the capabilities of a child.

OBJECT OF THE INVENTION

It is an object of the present invention to provide handle lock which is simple in construction and has a minimum of moving parts but which, at the same time, requires consecutive actions which are beyond the capability of a child.

SUMMARY OF THE INVENTION

According to the invention a handle lock includes a handle portion and a plate portion, the latter being attached to a door at the lock of the door, the handle being slidable in the plate between a first and second position and is also connected to a lock releasing element; releasable rotation preventing means between the handle and he plate when the handle is in its first position, such means being released when the handle is in its second position thereby permitting rotation of the handle, the sliding movement of the handle being controlled by abutment means displaceable by a finger-operable agency associated with the handle.

The second position of the handle is preferably push position but it will be appreciated that it may alternatively be a pull position. The releasable rotation preventing means may comprise a formation in one of the handle or plate which coacts with a corresponding formation in the other in the first position and which is displaced from the corresponding formation by the movement from the first to the second position.

In one form of the invention one formation is a pin and other a corresponding recess, which is biased to the first position, preferably by spring means.

The abutment means may take the form of one or more spring-loaded elements fixed to one of the handle or plate, the ends thereof abutting a surface in the other, for example, the element/s may be fixed to the plate and their ends abut a surface in the handle. The elements may comprise leaf springs biased to their abutment position.

Release of the abutment means may be provided by pins extending through the handle and which are actuable by finger-and-thumb pressure.

In operation, the finger-and-thumb pins are depressed thereby releasing the abutment and permitting the handle to be pushed to its second position. This releases the rotation-prevention means so that the handle can be rotated to activate the lock releasing element. This involves three consecutive steps—finger and thumb pressure, a push, and a rotation. It is believed that such a sequence is beyond the ability of a child's mind until an age of responsibility where ingestion of any substance or breakage of any article within reach in a cupboard is no longer a natural finction.

The plate may include a spring which will automatically rotate the handle back to the re-engagement of the rotation-prevention means, and the handle will then be returned to its first position by virtue of the spring in the handle.

BRIEF DESCRIPTION OF THE DRAWINGS

An embodiment of the invention is described below with reference to the accompanying drawings, in which:

FIG. 3 is an isometric view of the handle lock in the two positions of the handle.

DETAILED DESCRIPTION OF THE INVENTION

Figure 1:
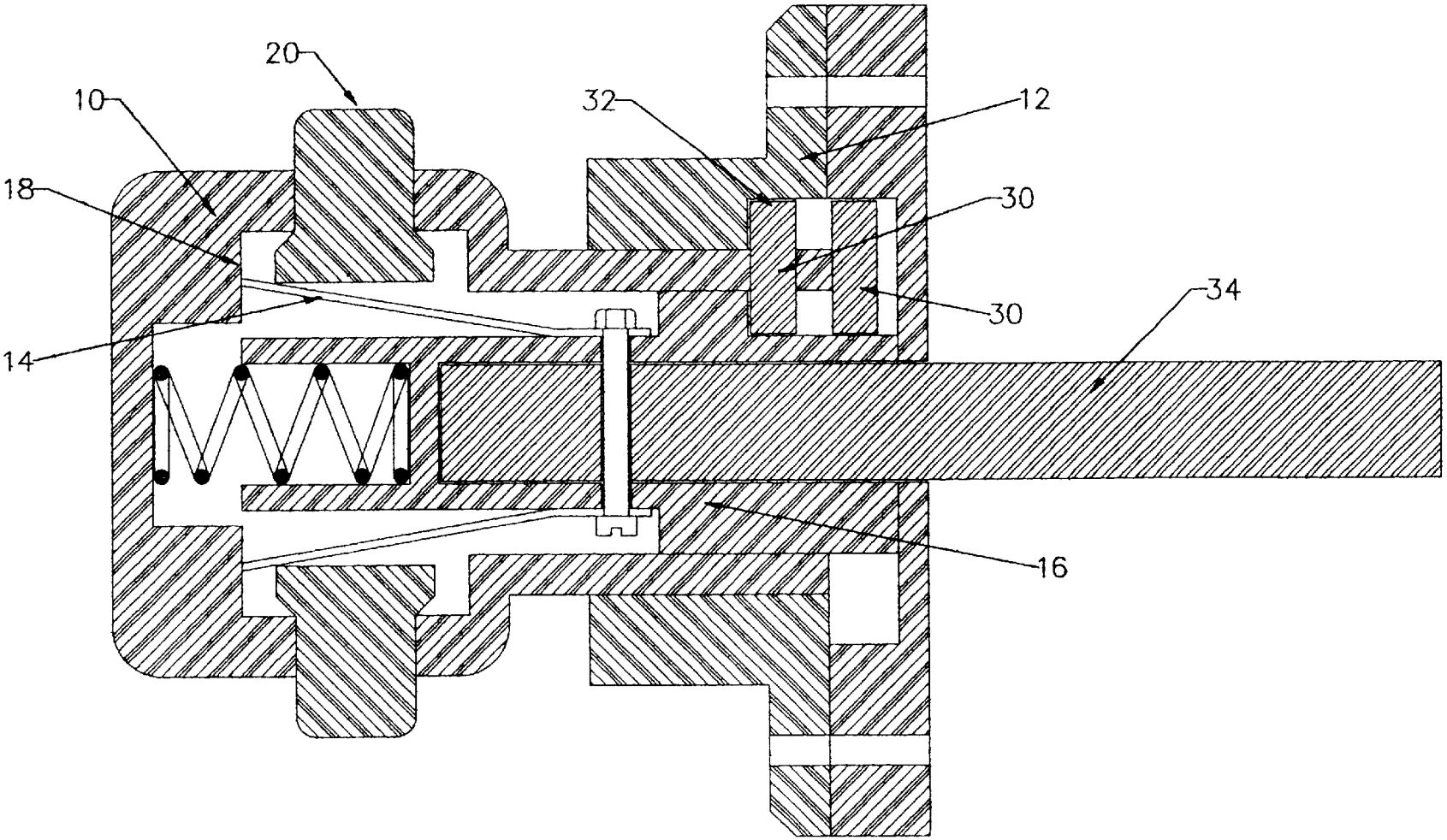
FIG. 1 is a sectional side view through a handle lock of the invention.

The lock comprises essentially a handle portion 10, a plate portion 12 and a lock releasing rod 14. The handle 10 is slidable within the plate 12 from a first position as shown in FIG. 1 to a second position to be described below.

In this first position, the handle is restrained from sliding into the plate by virtue of the pair of leaf springs 14 which are attached to a shaft 16 of the plate portion, and abut a shoulder 18 in the handle. These leaf springs may be displaced from their position by depressing the pins 20 between finger and thumb until they are parallel and are free of the shoulder. The handle can then be pushed into the plate against the action of a compression spring shown in FIG. 1.

Figure 2:
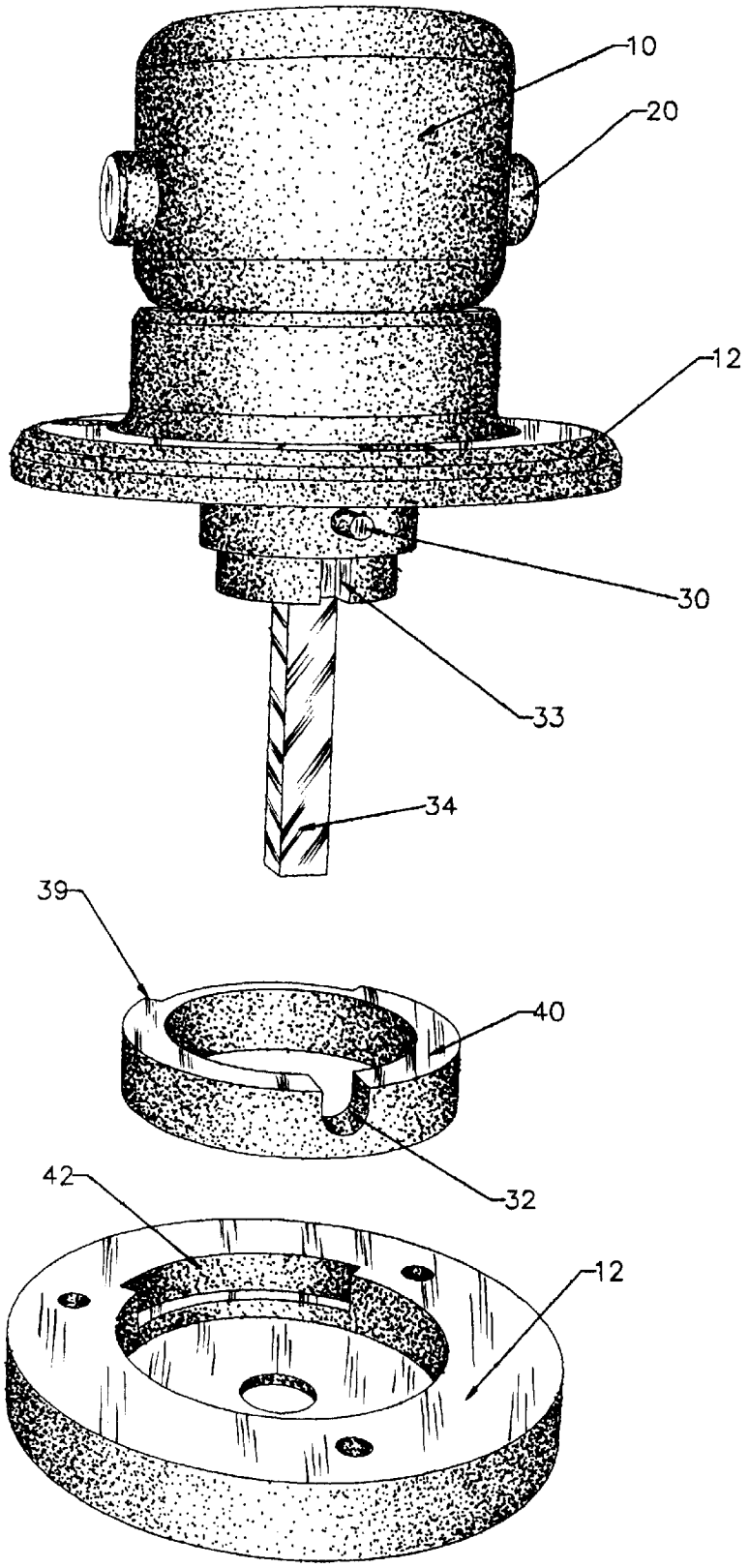
FIG. 2 is an exploded view of the handle lock.

Movement of the handle into the plate causes a pin 30, which is on the handle structure and which is held captive in a slot 32 in the plate, (thus preventing rotation), to become free by virtue of the registration of the slot 32 and slot 33 (see FIG. 2) At this stage also, a formation 39 on the element 40 abuts a coil spring (not shown) in the recess 42.

Further rotation of the handle can now take place and the rod 34 acts to release a lock (not shown).

Once the handle is released, the spring in the recess 42 causes the handle to rotate to its initial position and the compression spring causes the handle to retract to its first position.

What is claimed is:

1. A handle lock requiring at least three operations for unlocking including a handle and a plate, the plate being adapted to be attached to a door at the lock of the door, the handle being slidable in the plate between a first position and second position and also being connected to a lock releasing element, at least one spring-loaded element fixed to one of the handle or plate, ends of said element abutting a surface in the other of said handle or plate and preventing rotation between the handle and the plate when the handle is in said first position, the spring-loaded at least one element being released when the handle is in said second position, thereby permitting rotation of the handle, the sliding movement of the handle being controlled by abutment means displaceable by a finger-operable agency associated with the handle.

2. The handle lock according to claim 1 in which said elements comprise leaf springs biased to their abutment position.

3. The handle lock according to claim 1 in which the release of the abutment means is effected by pins extending through the handle and which are actuable by finger and thumb pressure.

4. A handle lock requiring at least three operations for unlocking, comprising a handle, a plate adapted to be attached to a door at the lock of the door, the handle being slidable in the plate between a first position and a second position and also being connected to a lock releasing element, leaf springs secured to the plate and diverging from each other in an unstressed condition, said leaf springs in said unstressed condition abutting a portion of said handle, and pins extending through the handle and movable toward each other under finger pressure to move said leaf spring from said unstressed condition toward each other to a position in which said leaf springs no longer abut said handle but permit said handle to be moved from said first position to said second position, said handle in said second position being adapted to rotate to actuate said lock releasing element.

* * * * *